US005365142A

United States Patent [19]

Nishimura et al.

[11] Patent Number: 5,365,142

[45] Date of Patent: Nov. 15, 1994

[54] CATHODE-RAY TUBE WHEREIN PLURAL REGIONS OF PHOSPHOR SCREEN ARE SCANNED INDEPENDENTLY OF ONE ANOTHER

[75] Inventors: Takashi Nishimura; Kazuyuki Seino; Eiji Kamohara, both of Fukaya, Japan

[73] Assignee: Kabushiki Kaisha Toshiba, Kawasaki, Japan

[21] Appl. No.: 945,415

[22] Filed: Sep. 16, 1992

[30] Foreign Application Priority Data

| | | | |
|---|---|---|---|
| Dec. 26, 1991 | [JP] | Japan | 3-343800 |
| Dec. 26, 1991 | [JP] | Japan | 3-343802 |
| Dec. 26, 1991 | [JP] | Japan | 3-343803 |
| Dec. 26, 1991 | [JP] | Japan | 3-343804 |

[51] Int. Cl.[5] ..... H01J 31/20; H01J 29/07

[52] U.S. Cl. ..... 313/2.1; 313/408; 313/422; 313/482

[58] Field of Search ..... 313/2.1, 402, 408, 422, 313/476, 482, 495; 315/374

[56] References Cited

U.S. PATENT DOCUMENTS

| | | | |
|---|---|---|---|
| 4,635,105 | 1/1987 | Favreau | 313/477 R |
| 4,714,856 | 12/1987 | Takenaka et al. . | |
| 4,900,976 | 2/1990 | Livshultz et al. | 313/402 |
| 4,900,981 | 2/1990 | Yamazaki et al. | 313/477 R |
| 4,994,704 | 2/1991 | Takenaka et al. | 313/2.1 |
| 5,032,756 | 7/1991 | Takenaka et al. | 313/2.1 |

FOREIGN PATENT DOCUMENTS

| | | |
|---|---|---|
| 0201865 | 11/1986 | European Pat. Off. . |
| 0235894 | 9/1987 | European Pat. Off. . |
| 64-10553 | 1/1989 | Japan . |
| 2501687 | 6/1990 | Japan . |
| 1070624 | 1/1984 | U.S.S.R. . |

*Primary Examiner*—Donald J. Yusko
*Assistant Examiner*—N. D. Patel
*Attorney, Agent, or Firm*—Cushman, Darby & Cushman

[57] ABSTRACT

A cathode-ray tube includes an envelope having a rectangular face plate and a rectangular, flat rear plate opposed to the face plate. A phosphor screen is formed on the inner surface of the face plate and has a number striped phosphor layers extending in parallel to one another, and a plurality of regions which are independently scanned by electron beams. A mask support mechanism for supporting a shadow mask in the envelope comprises first mask support members fixed to the inner surface of the rear plate and situated to face first longitudinal ends of the phosphor layers, second mask support members fixed to the inner surface of the rear plate and situated to face second longitudinal ends of the phosphor layers, and central mask support members fixed to the inner surface of the rear plate and situated between the first and second support portions. The shadow mask is supported on the mask support members while being applied with a tensile force in the longitudinal direction of the phosphor layers.

19 Claims, 8 Drawing Sheets

CATHODE-RAY TUBE WHEREIN PLURAL REGIONS OF PHOSPHOR SCREEN ARE SCANNED INDEPENDENTLY OF ONE ANOTHER

BACKGROUND OF THE INVENTION

1. Field of the Invention

The present invention relates to a cathode-ray tube such as a monochrome or color image picture tube, and more particularly to a cathode-ray tube wherein a phosphor screen is coated on the inner surface of a face plate and has a plurality of regions, which are scanned independently of one another.

2. Description of the Related Art

Recently, various research has been made in high-quality broadcasting and high-resolution picture tubes having a large screen designed for the high-quality broadcasting. In general, in order to achieve high resolution of a picture tube, the spot diameter of an electron beam on a phosphor screen must be reduced. For this purpose, in the prior art, the structure of an electrode of an electron gun has been improved, or the caliber and/or length of the electron gun has been increased. However, satisfactory achievement has not been obtained. The main reason is that the distance between the electron gun and the phosphor screen increases in accordance with the increase in size of the picture tube and the magnification of the electron lens increases excessively. Accordingly, in order to achieve high resolution, it is important to shorten the distance (depth) between the electron gun and the phosphor screen. In addition, when the deflection angle of an electron beam is increased, the difference in magnification between the center area and peripheral area of the phosphor screen increases. Thus, wide-angle deflection is not advantageous for achieving high resolution.

Under the circumstances, in the prior art, there is known a method of arranging a plurality of independent small-sized picture tubes, thereby constituting a high-resolution, large screen. This kind of method is effective for large-scale screen displays having a large number of divided regions, which is designed for outdoor installation. However, when this method is applied to middle-scale screen display (e.g. the screen size is about 40 inches), connection portions between the divided regions of the screen are conspicuous, resulting in low-quality images. Thus, when the display formed by this method is used a household TV receiver or computer-aided design (CAD), the connection portions on the screen are a serious defect.

On the other hand, U.S. Pat. No. 4,714,856 discloses a picture tube wherein a plurality of independent picture tubes are continuously arranged and the screens of these picture tubes are integrated. According to that design, the picture tube has an integrated phosphor screen, a vacuum envelope is constituted by a face plate having an inner surface coated with a phosphor screen, a rear plate is opposed to the face plate, funnels are adjacent to the rear plate, and necks are provided on the funnels. The face plate is formed of glass, and the rear plate is formed of glass or metal.

In the case of this structure of the envelope, however, if the screen surface becomes broader, it is necessary to increase the thickness of the face plate or rear plate in order to withstand the load of atmospheric pressure (external pressure). In addition, it is necessary to provide the face plate with a high curvature in the tube axis direction. As a result, the weight of the envelope becomes considerably heavy, and moreover the screen of the picture tube with the face plate having such a high curvature in the tube axis direction cannot be viewed clearly. In addition, the distance between the phosphor screen and the electron gun sealed within the neck increases, and the magnification of the electron lens is adversely affected.

In order to solve the problems described above, it is necessary to provide the face plate, in particular, with a relatively flat, large area. In this case, it is also necessary to provide the envelope with support means for supporting the load of atmospheric pressure applied to the face plate.

A picture tube with this support means is disclosed, for example, in Published Unexamined Japanese Patent Application (PUJPA) No. 64-10553. According to that picture tube, an elongated plate-shaped support member is provided between a flat face plate and a rear plate as the support means for withstanding the atmospheric pressure applied to the evacuated flat envelope. There is another example wherein a needle-shaped support member is provided, in addition to that support member.

It is desirable that the support means be situated outside the locus of the electron beam, if possible, in order to prevent a shadow from being thrown on the phosphor screen when the electron beam collides with the support means, and that the area of contact between the support means and the phosphor screen be reduced as much as possible, thereby reducing the area of non-light-emitting portion produced by this contact.

There are many problems, however, in the structure wherein the elongated plate-shaped or needle-shaped support members are provided between the face plate and the rear plate, which are used withstand the load of the atmospheric pressure applied to the evacuated flat envelope. For example, the elongated plate-shaped support members have problems: (a) processing precision, (b) strength against load, (c) fixing method, (d) cost, etc. Further, the needle-shaped support members have a problem of (e) increase in number of used support members.

The above picture tube is effective, in particular, when the screen size is large, but various problems occur when that picture tube is applied to a cathode-ray tube for displaying color images, i.e. a color picture tube having therein a shadow mask serving as a color selection electrode.

First, there is a problem in the method of attaching the shadow mask. Specifically, in the case of a conventional color picture tube having a spherical face plate, and a spherical shadow mask. In this case, by fixing a peripheral portion of the shadow mask to a metallic frame (mask frame), practical mechanical strength can be given to the shadow mask and it becomes easy to situate the shadow mask in a predetermined positional relationship with the phosphor screen, which is formed on the inner surface of the face plate. However, in the case of a flat face plate, the shadow mask must also be flattened, and therefore the mechanical strength of the shadow mask is low. Accordingly, that shadow mask cannot easily be situated in a predetermined positional relationship with the phosphor screen formed on the inner surface of the face plate, only by fixing the peripheral portion of the shadow mask, as in the prior art.

In general, regarding a flat shadow mask or a cylindrical shadow mask which has a curvature only in one direction, sufficient mechanical strength is given to the shadow mask by fixing it to a robust metallic frame with a tensile force applied to the shadow mask, and the shadow mask is attached to the face plate via this metallic frame. In this method, however, if the size of the shadow mask increases in accordance with the increase in screen size, the tensile force applied to the shadow mask must be increased accordingly. Consequently, a more robust metallic frame is required. In this case, not only the weight of the entire picture tube increases, but also the attaching means for attaching the shadow mask to the face plate via the metallic frame must have a special structure. Furthermore, a sufficient space for providing the attaching means is required.

Secondly, there is a problem in precision of arrangement of the shadow mask. A phosphor screen of a regular color picture tube is formed on the inner surface of a face plate by a photo-engraving method, by using a shadow mask built into the color picture tube on the basis of a projection image formed through the shadow mask. Thus, if a distance (q-value) between the shadow mask and the inner surface of the face plate departs from a predetermined value, the arrangement pitch of phosphor layers is affected but the continuity of the entire phosphor screen is not affected. On the other hand, in the case of a color picture tube wherein an integrated phosphor screen has a plurality of regions which are scanned independently of one another, the continuity of the phosphor screen, i.e. the continuity of images projected onto adjacent regions of the shadow mask, is affected by the q-value. More specifically, when the q-value is greater than a predetermined value, projected images on adjacent regions overlap one another; when the q-value is less than a predetermined value, a gap is produced between projected images on adjacent regions.

In addition, when a phosphor screen is formed by a so-called master mask method, (i.e. by using an exposure mask or a dry plate), the distance between the shadow mask and the inner surface of the face plate on which the phosphor screen is formed must be exactly determined. If the q-value is not exact, an electron beam does not land on a predetermined phosphor layer, rasters between adjacent regions overlap one another, or a gap is produced between the rasters. Further, the required precision of the q-value is about 0.05 mm, though it depends on the horizontal deflection angle or the arrangement pitch of the shadow mask. As can be seen from the fact that the required manufacturing precision of the conventional color picture tube is about 0.5 mm, very high precision is required of the q-value. In other words, it is difficult to provide the shadow mask with a high precision by the conventionally known means.

For example, International Patent Application PCT/US87/02869 discloses a picture tube wherein a shadow mask is supported on the inner surface of a face plate (i.e. on a phosphor screen) via attaching members. This shadow mask is supported in the state in which both end portions thereof are attached to the attaching members. In the case of this structure, however, the attaching members cannot be mounted on a central portion of the phosphor screen, in order to prevent occurrence of shadow on the phosphor screen due to collision of electron beam with the attaching members and occurrence of non-light-emitting portions. Thus, the attaching members are disposed on only outer edge portions of the phosphor screen, and only both end portions of the shadow mask are supported by the attaching members. Accordingly, the central portion of the shadow mask cannot be supported by the attaching member. Thus, in particular, when the screen size is large, the central portion of the shadow mask may easily be warped.

As a result, with this picture tube, too, it is difficult to have the shadow mask supported on the phosphor screen with high precision.

SUMMARY OF THE INVENTION

The present invention has been made to solve the problems described above, and its object is provide a cathode-ray tube of the type in which a phosphor screen formed on the inner surface of face plate has a plurality of regions which are scanned independently of one another, wherein a shadow mask can be situated with high precision to face the phosphor screen, and fixing members for the shadow mask is simplified and reduced in weight, whereby the cathode-ray tube is provided with high practical and industrial advantages.

In order to achieve the above object, there is provided a color cathode-ray tube comprising: an evacuated envelope having a substantially rectangular first plate and a substantially rectangular second flat plate opposed to the first plate substantially in parallel; a phosphor screen formed on the inner surface of the first plate and having a number of mutually parallel striped phosphor layers and a plurality of regions; a shadow mask arranged within the envelope; mask support means for supporting the shadow mask such that the shadow mask is opposed at a distance to the phosphor screen, said mask support means comprising a first support portion fixed on the inner surface of the second plate and situated to face first longitudinal end portions of the phosphor layers, a second support portion fixed on the inner surface of the second plate and situated to face second longitudinal end portions of the phosphor layers, and an intermediate support portion fixed on the inner surface of the second plate and situated between the first and second support portions, said shadow mask being support on the first, second and intermediate support portions in the state in which a tensile force is applied in the direction of extension of the phosphor layers; and beam emitting means attached to the second plate, for emitting electron beams for scanning the regions of the phosphor screen independently of one another.

According to the cathode-ray tube with the above structure, both end portions of the shadow mask are supported by the first and second support portions and the intermediate portion of the shadow mask is supported by the central support portion, whereby the shadow mask can be positioned with high precision in relation to the phosphor screen. Further, each support portion is fixed on the inner surface of the second plate. Thus, even in the case where the intermediate support portion is situated, for example, at positions facing the center part of the phosphor screen, the electron beams emitted from the emitting means do not collide with the intermediate support portion and occurrence of shadow on the phosphor screen or formation of non-light-emitting portions can be prevented.

According to the present invention, the cathode-ray tube is provided with fixing portions secured on the inner surface of the second plate, and the support portions of the support means for supporting the shadow mask are fixed on the fixing portions.

According to the above structure, the fixing portions are secured on the second plate beforehand by using, e.g. frit glass, and the support portions are exactly welded on the fixing portions by, e.g. laser welding at normal temperatures. When the frit glass is melted to secure the fixing portions on the second plate, it is necessary to position the fixing portions by means of a positioning jig and heat the related parts at high temperatures (several hundred degrees centigrade). Thus, at the time of heating, a variation arises in the temperature distribution in the relates parts, with the result that the precision of securing the fixing portions lowers. However, the support portions can be fixed, e.g. by laser welding, on the fixing portions at low temperatures capable of preventing thermal expansion and contraction of the related parts. Thus, even if the precision of securing the fixing portions is slightly low, the support portions can be fixed with high precision in a predetermined positional relationship with the second plate and the shadow mask. Accordingly, by attaching the shadow mask to the support members, the cathode-ray tube with high assembly precision can be obtained.

Furthermore, a cathode-ray tube according to the present invention comprises fixing portions secured on the inner surface of the second plate, and plate support means for supporting the first plate. The plate support means has the plate support members fixed on the fixing portions, and the plate support members has contact portions put in contact with the inner surface of the first plate.

According to the cathode-ray tube with the above structure, the fixing portions are secured on the second plate beforehand by using, e.g. frit glass, and the support portions are exactly welded on the fixing portions by, e.g. laser welding at normal temperatures. Thus, like the above, the plate support members can be exactly attached to the second plate with high precision, and a variation in height of the plate support members can be decreased.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 1 through FIG. 8 show a color cathode-ray tube according to a first embodiment of the present invention, wherein:

FIG. 1 is a perspective view showing the structure of the cathode-ray tube; FIG. 2 is a cross-sectional view taken along line A—A in FIG. 1;

FIG. 3 is an exploded perspective view showing the assembly structure of the cathode-ray tube;

FIG. 4 is an enlarged cross-sectional view showing a phosphor screen;

FIG. 5 is a cross-sectional view showing the mount structure of mask support members of the cathode-ray tube;

FIG. 6 is an enlarged perspective view of a plate support member;

FIG. 7 is a cross-sectional view showing the mount structure of the plate support members; and FIG. 8 is an enlarged cross-sectional view showing a tip portion of the plate support member and the phosphor screen.

FIG. 9 through FIG. 13 show a color cathode-ray tube according to a second embodiment of the present invention, wherein:

FIG. 9 is an exploded perspective view of the cathode-ray tube;

FIG. 10 is a cross-sectional view showing the mount structure of mask support members;

FIG. 11 is a plan view is a plan view showing a first fixing member;

FIG. 12 a cross sectional view showing the mount structure of plate support members; and FIG. 13 is a plan view showing a second fixing member.

DETAILED DESCRIPTION OF THE PREFERRED EMBODIMENTS

A first embodiment of the present invention will now be described with reference to the accompanying drawings.

Figure 1:
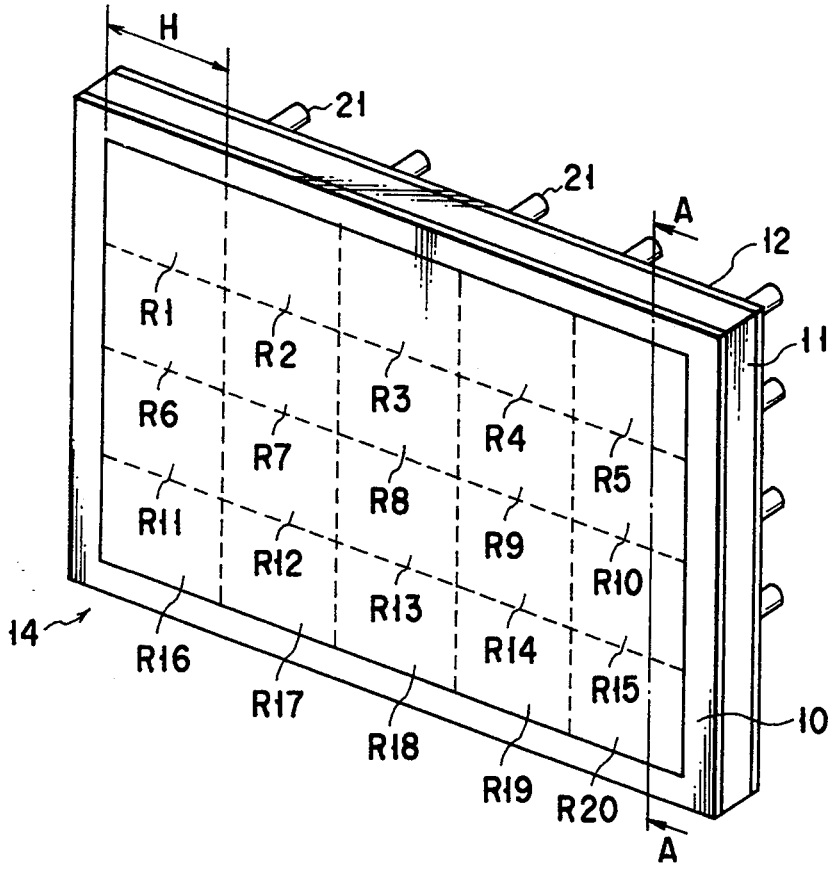
Figure 2:
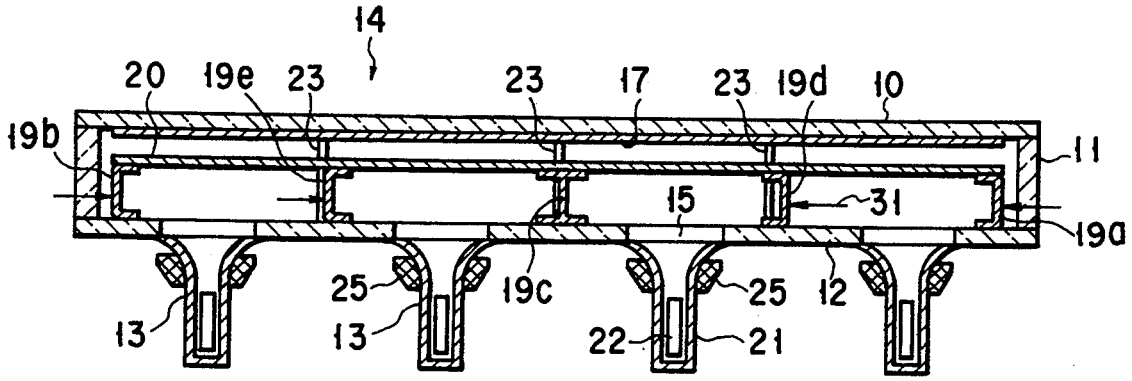

FIGS. 1 through 8 show an embodiment of the invention applied to a color cathode-ray tube. The cathode-ray tube has a vacuum envelope 14. The vacuum envelope 14 comprises a substantially rectangular, flat glass face plate 10 (first plate), a rectangular frame like side wall 11 fixed to the peripheral edge of the face plate 10 and extending substantially perpendicular thereto, a rectangular, flat glass rear plate 12 (second plate) fixed to the side wall 11 and opposed to the face plate 10 in parallel, and funnels 13, as seen in FIG. 2 fixed to the rear plate 12. The rear plate 12 is provided with, for example, 20 rectangular openings 15. The openings 15 are arranged in a matrix, e.g. five (vertical) X four (horizontal). The funnels 13 are coupled to the outer surface of the rear plate 12 so as to surround the corresponding openings 15.

Figure 3:
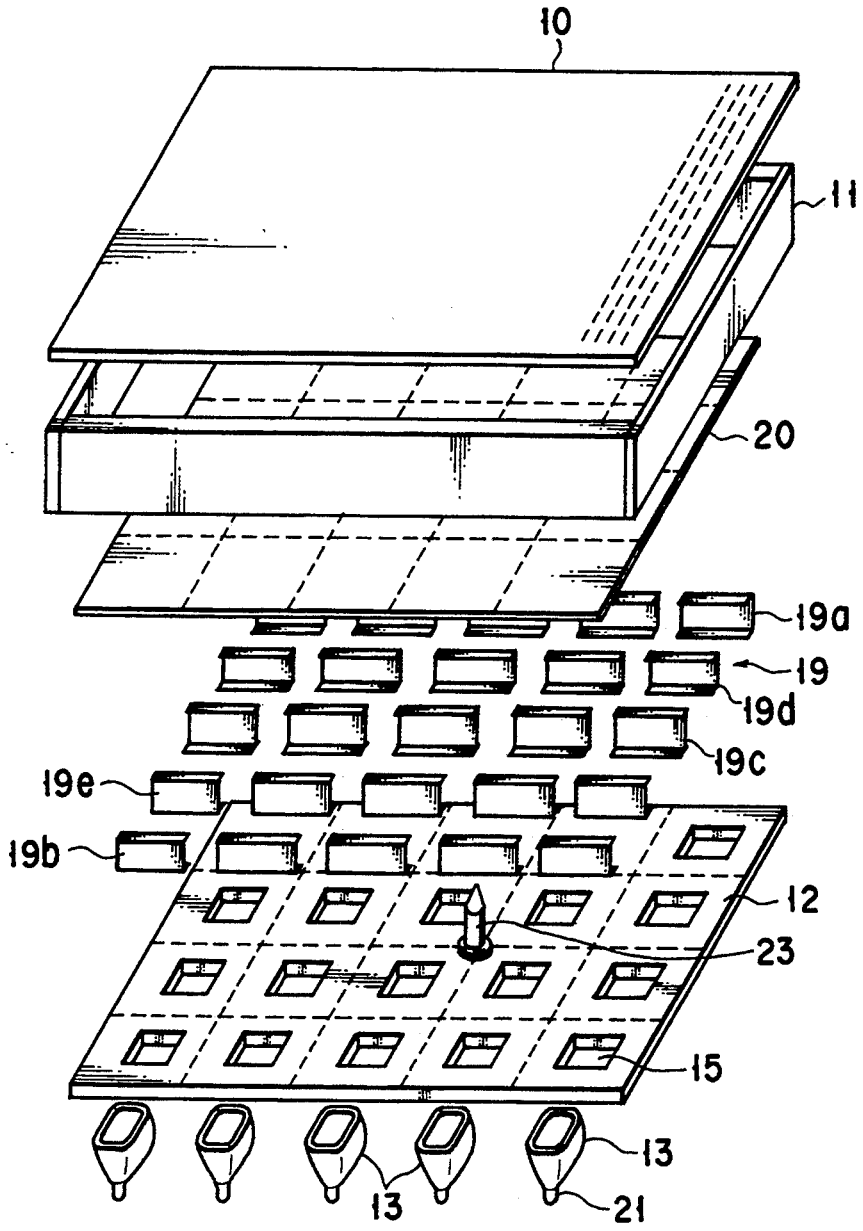
Figure 4:
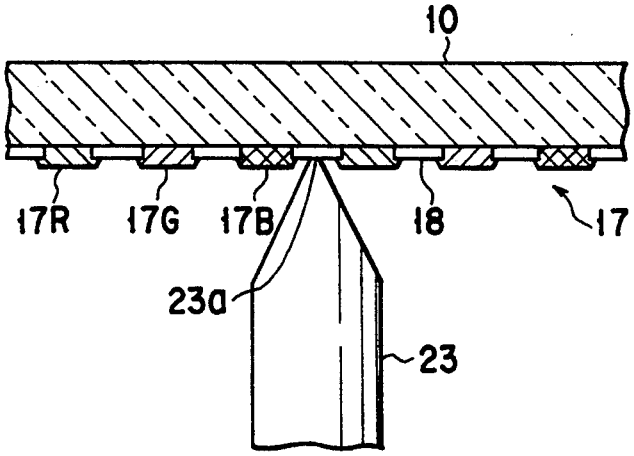

As shown in FIG. 4, a phosphor screen 17 is formed on the inner surface of the face plate 10. The phosphor screen 17 has stripe-shaped three-color phosphor layers 17B, 17G and 17R which emit blue, green and red light, respectively, and black stripes 18 provided between the three-color phosphor layers. All stripes extend vertically (in FIGS. 1 to 3) in parallel to one another. Between the face plate 10 and the rear plate 12 is provided a shadow mask 20 as shown in FIG. 2, which has a number of holes for passing electron beams and faces the phosphor screen 17. The shadow mask 20 is supported on the rear plate 12 by means of mask support members 19 (described later). An electron gun 22 (beam emitting means) for emitting an electron beam is provided within a neck 21 of each funnel 13. Columnar plate support members 23 (described later) penetrating the shadow mask 20 are disposed between the face plate 10 and the rear plate 12.

An electron beam emitted from the electron gun 22 is deflected vertically and horizontally by a deflection yoke 25 mounted on the outer surface of the funnel 13. Thus, 20 regions R1, R2, R3 . . . R20 (five regions in each row; four regions in each column) of the phosphor screen 17 are individually scanned by electron beams traveling through the shadow mask 20. Rasters formed on the phosphor screen 17 by this divisional scan are connected with each other by signals applied to the electron guns 22 and deflection yokes 25, whereby a single large raster, free from discontinuity, is formed on the entire phosphor screen 17.

Figure 5:
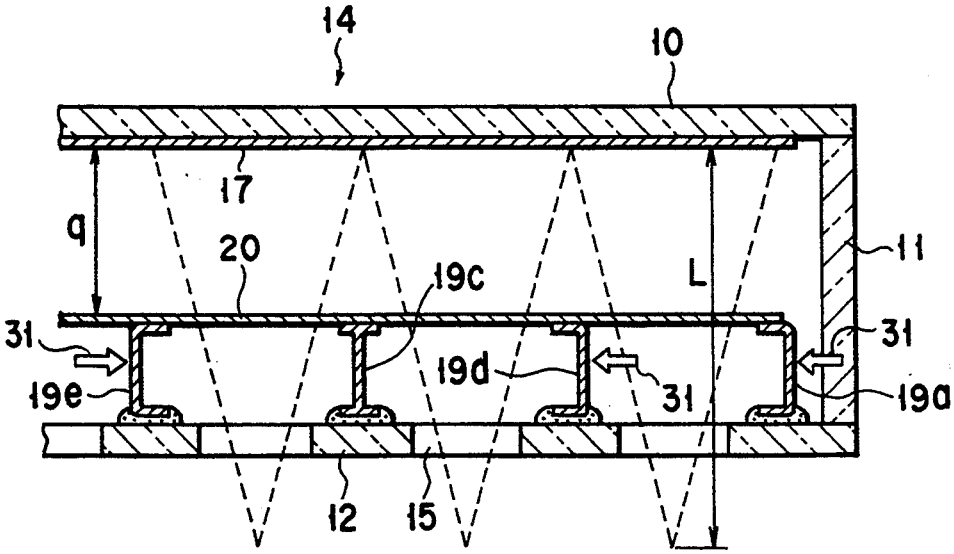

The mask support members 19 are fixed on the inner surface of the rear plate 12 by means of frit glass, as shown in FIGS. 2, 3 and 5, in five rows extending horizontally (i.e. in a direction perpendicular to the direction of extension of the phosphor layers of the phosphor screen 17). Specifically, the mask support members 19 comprise, for example, five first support members 19*a* arranged along the upper edge of the rear plate 12, five second support members 19*b* arranged along the lower edge of the rear plate, five central support members 19*c* arranged along the center line of the rear plate, third support members 19*d* arranged between the first support members and the central support members, and fourth support members 19*e* arranged between the second support member and the central support members. The central support members 19*c*, third support members 19*d* and fourth support members 19*e* are fixed at areas between two vertically adjacent openings 15. Accordingly, these support members 19*c*, 19*d* and 19*e* are situated to face horizontal boundary portions between the independently scanned regions R1 to R20.

Each support member 19 is made of an elastic material, for example, a nickel alloy, having a thermal expansion property similar to that of the rear plate 12. Each of the first to fourth support members 19*a*, 19*b*, 19*d* and 19*e*, excluding the central support members 19*c*, has a substantially U-shaped cross section and is formed of a rectangular flat plate whose upper and lower end portions are bent in one direction substantially at right angles. As can be seen from FIG. 2, one of the two bent portions of each of the support members 19*a*, 19*b*, 19*d* and 19*e* is fixed to the inner surface of the rear plate 12, in the state in which the longitudinal axis of the support member extends in the horizontal direction. The bent portions of the first and third support members 19*a* and 19*d* are fixed to extend toward the central support members 19*c*, and the bent portions of the second and fourth support members 19*b* and 19*e* are fixed to extend toward the central support members 19*c*.

Each of the central support members 19*c* has a substantially I-shaped cross section, and is fixed to the inner surface of the rear plate 12 such that its longitudinal axis extends in the horizontal direction.

As compared with the phosphor screen, the shadow mask 20 is constructed such that electron beam passage holes are formed in only those areas (effective areas) of the mask which correspond to the regions R1, R2, R3 . . . R20 of the phosphor screen 17 necessary for forming a single raster with no discontinuity between the regions R1, R2, R3 . . . R20, and no electron beam passage holes are formed in areas existing between the effective areas or in the peripheral portion of the mask. The areas of the shadow mask 20, which are between the effective areas, and the peripheral portion of the shadow mask 20 are welded to the mask support members 19. Thus, the shadow mask 20 is supported by the support members 19 in a predetermined position in relation to the phosphor screen 17. In particular, the upper end portion of the shadow mask 20, which faces the longitudinal upper end portions of the phosphor layers, is supported by the first support members 19*a*, and the lower end portion of the shadow mask 20, which faces the longitudinally lower end portions of the phosphor layers, which is supported by the second support members 19*b*. The portions between the upper and lower end portions of the shadow mask 20 are supported by intermediate support members (i.e. the central, third and fourth support members 19*c*, 19*d* and 19*e*).

Figure 6:
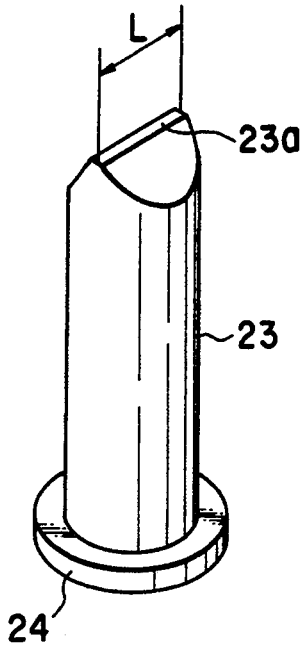
Figure 7:
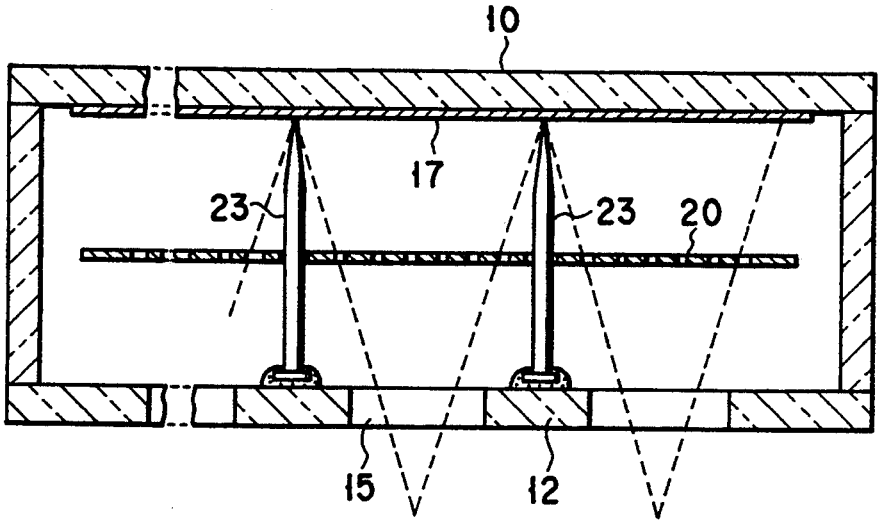
Figure 8:
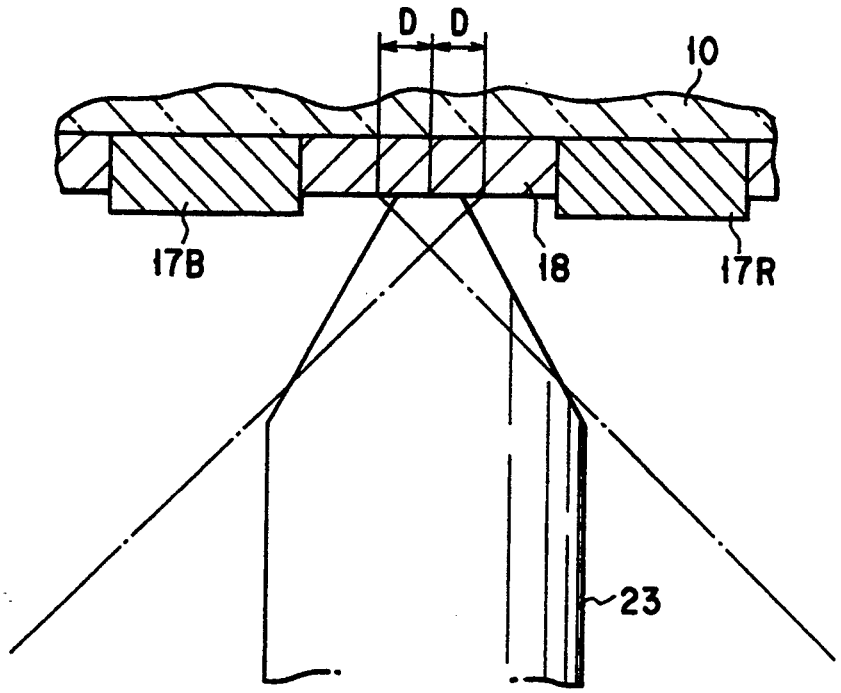

The plate support members 23 are provided to withstand the load applied to the face plate 10 and rear plate 12 of the vacuum envelope 14 due to atmospheric pressure. As is shown in FIG. 6, each plate support member 23 is formed of a cylindrical rod of a nickel alloy having a thermal expansion property similar to that of the rear plate 12. A distal end portion of the support member 23 is formed in a wedge shape and has an elongated flat contact face 23*a*. A flange 24 is formed on the outer circumference of a proximal end of the support member 23. The length L of the contact face 23*a* is about 15 mm. The proximal end of each plate support member 23 is fixed to the inner surface of the rear plate 12 by means of frit glass. Each support member 23 extends through a through-hole formed in the shadow mask 20. The contact face 23*a* of each support member 23 is put into contact with the phosphor screen 17.

In particular, each support member 23 is disposed between horizontally adjacent mask support members 19, and penetrates that portion of the shadow mask 20, which is not provided with the electron beam passage holes. The support members 23, however, are not provided between adjacent first support members 19*a* or between adjacent second support members 19*b*. As shown in FIG. 4, the support members 23 are fixed to the rear plate 12 such that their contact faces 23*a* come into contact with the black stripes 18 of the phosphor screen 17 at intersections of the scanned regions R1, R2, R3 . . . R20 and the longitudinal direction of the contact faces 23*a* coincide with that of the black stripes 18. Further, each contact face 23*a* is put on a center line of the corresponding black stripe 18 so as not to be situated, at least, outside the longitudinal side edges of the black stripe 18.

In this case, for example, when the arrangement pitch of the three-color phosphor layers 17B, 17G and 17R is 0.6 mm and the area ratio of the black stripes 18 to the entire phosphor screen 17 is 50%, the width of each black stripe is 0.1 mm. Thus, it is desired that the width of the contact face 23*a* of each plate support member 23 be 0.01 mm or less. The contact face 23*a* can be worked to have a width of 0.01 mm or less by a polishing process. Before the vacuum envelope 14 is formed, the plate support members 23 are disposed on the rear plate 12 and positioned on the black stripes 18 with a precision of about ±0.03 mm.

The above-described color cathode-ray tube is manufactured in the following process.

First, the phosphor screen 17 is formed on the inner surface of the face plate 10. The mask support members 19 and plate support members 23 are positioned on the inner surface of the rear plate 12. After coating frit glass on the inner surface of the rear plate 12, it is sintered. Thus, the mask support members 19 and plate support members 23 are fixed at predetermined positions on the inner surface of the rear plate 12. The shadow mask 20 is welded on the mask support members 19, which are fixed to the rear plate 12, while a tensile force is being applied to the shadow mask 20 by a method described below. The electron gun 22 is sealed within the neck 21 of each funnel 13. The face plate 10 on which the phosphor screen 17 is formed, the side wall 11, the rear plate 12 on which the mask support members 19, plate support member 23 and shadow mask 20 are attached, and the funnels 13, with the electron guns 22 sealed therein, are positioned in a predetermined positional relationship, and then these elements are coupled as one integrated body by means of frit glass. Thereafter, this integrated envelope is evacuated, and a color cathode-ray tube is obtained.

There are other various methods for manufacturing the color cathode-ray tube. For example, according to one method, the face plate 10 on which the phosphor screen 17 is formed, the side wall 11, and the rear plate 12 on which the mask support members 19, plate support member 23 and shadow mask 20 are attached are positioned in a predetermined positional relationship and coupled as one integrated body by frit glass. Then, the funnels 13 in which the electron guns 22 are sealed are fixed to the rear plate by frit glass, thereby integrating all these components into a single unit.

As has been described above, in the case where the mask support members 19 are fixed to the rear plate 12 and then the shadow mask 20 are welded onto these support members, even if the support members 19 are arranged on areas facing the central portion of the phosphor screen 17, the electron beams emitted from the electron guns 22 are not shielded by the support members 19. Thus, not only both end portions but also the central portion of the shadow mask 20 can be supported by the mask support members 19. As a result, the entire shadow mask 20 can be exactly positioned in relation to the phosphor screen 17.

In the above structure, by forming the mask support members 19 beforehand with a predetermined processing precision, the height of the shadow mask attachment faces of the support members can be made constant with a desired precision. Thus, the distance between the entire front surface of the shadow mask 20 and the phosphor screen 17 can be exactly maintained.

In addition, there is an advantage in which each mask support member 19 does not require very high processing precision. For example, in the case where the arrangement pitch of the striped three-color phosphor layers 17B,17G and 17R of the phosphor screen 17 formed on the inner surface of the face plate 10 is 0.6 mm and the width of each black stripe 18 is about 0.1 mm, in order to arrange the phosphor layers continuously, the overlapping width or gap of electron beams emitted from adjacent two electron guns 22 must be ½ or less of the width of the black stripe 18. In the case of the cathode-ray tube of this embodiment wherein the horizontal length H of each of the regions R1, R2, R3 . . . R20 is 80 mm, the distance L (FIG. 5) between the phosphor screen 17 and the deflection center of each deflection yoke 25 is 56 mm and the distance q between the phosphor screen 17 and the shadow mask 20 is 8 mm. When the overlapping width of the electron beams at the boundary portions of the regions R1, R2, R3 . . . R20 is D (see FIG. 8), a displacement Δq from a predetermined q value is expressed by $$\Delta q = D \cdot (L-q)/(H/2+D)$$

Accordingly, the required precision of q value of this cathode-ray tube (i.e., the required processing precision of the mask support member 19) is 0.06 mm. Thus, this cathode-ray tube can be mass-produced by a conventional, low-cost processing method.

Since the shadow mask 20 of this cathode-ray tube is flat, with no curvature, like the flat face plate 10, it is desired to apply a tensile force to the shadow mask 20 so as to suppress thermal deformation or vibration. According to one method of applying a tensile force to the shadow mask 20 of the cathode-ray tube of this embodiment, the shadow mask 20 is welded onto the mask support members 19 while forces 26 acting in the directions of arrows 31 (i.e. acting from the side wall 11 toward the center of the shadow mask) are applied to the mask support members 19*a*, 19*b*, 19*d* and 19*e* so that the mask support members are resiliently deformed and inclined slightly, as shown in FIGS. 2 and 5. When the forces indicated by arrows 31 are released after the welding, the shadow mask 20 is applied with a tensile force produced by the restoring force of the deformed mask support members 19.

In this case, the tensile force acts on the shadow mask 20 in the axial direction of the striped three-color phosphor layers. In the conventional color cathode-ray tube, the tensile force increases exponentially in accordance with the size of the screen. However, in the cathode-ray tube of this embodiment, the shadow mask 20 is substantially divided into a plurality of parallel regions by the mask support members 19. Thus, the size of each region of the shadow mask 18, which is situated between the mask support members 19, is substantially equal to the size (width) of a shadow mask of a small-sized color picture tube. Accordingly, the tensile force needed for suppressing thermal deformation or vibration of each region of the shadow mask 20 may be equal to that of the shadow mask of small-sized color picture tube.

For example, each mask support member 19 is obtained by forming a nickel alloy plate of 0.8 mm thick in a U-shape 20 mm high. When the shadow mask 20 is attached to the mask support members 19, the mask support members 19*a* and 19*b* of the outermost rows are inclined about 3 mm toward the center of the mask, the mask support members 19*d* and 19*e* of the intermediate rows are inclined about 1.5 mm toward the center of the mask, and the central support members 19*c* are not inclined, as shown in FIG. 2. In this state, the shadow mask 20 is attached. Thereby, substantially uniform tensile force can be applied to the entire shadow mask 20.

Since the mask support members 19 can be fixed with high precision, twist or wrinkles of the shadow mask 20 due to positional displacement of the mounted mask support members 19 can be prevented, and the tensile force of all regions of the shadow mask 20 can be made uniform.

In addition, as described above, the shadow mask 20 is constructed such that electron beam passage holes are formed in only those effective portions thereof which correspond to the regions R1, R2, R3 . . . R20 of the phosphor screen 17 necessary for forming a single raster with no discontinuity between the regions R1, R2, R3 . . . R20, and no electron beam passage holes are formed in portions existing between the effective portions or in the peripheral portions. Thus, even if the electron beam is scanned beyond the predetermined effective portion, no light is emitted from the phosphor layers of the adjacent regions of the phosphor screen 17, and images can be stably displayed for a long time. Further, since the shadow mask 20 is welded on the mask support members 19 at its portions existing between the effective portions and existing in the peripheral portions which are provided with no electron beam passage holes, deformation of the shadow mask due to heat by welding can be prevented. In addition, the plate support members 23 penetrate the portions existing between the effective portions and in the peripheral portions which are provided with no electron beam passage holes. Thus, the mask support members 19 and plate support members 23 do not interfere with the electron beams for scanning the regions R1, R2, R3 . . . R20 of the phosphor screen 17, and an image with no discontinuity can be displayed on the phosphor screen.

FIGS. 9 through 13 show a second embodiment of the invention.

In the first embodiment, the mask support members 19 for supporting the shadow mask 20 and the plate support members 23 for withstanding the load applied to the face plate 10 and rear plate 12 are directly fixed to the rear plate 12. According to the second embodiment, however, the support members 19 and 23 are fixed to the rear plate 12 via first and second fixing members 28 and 30, respectively.

Figure 10:
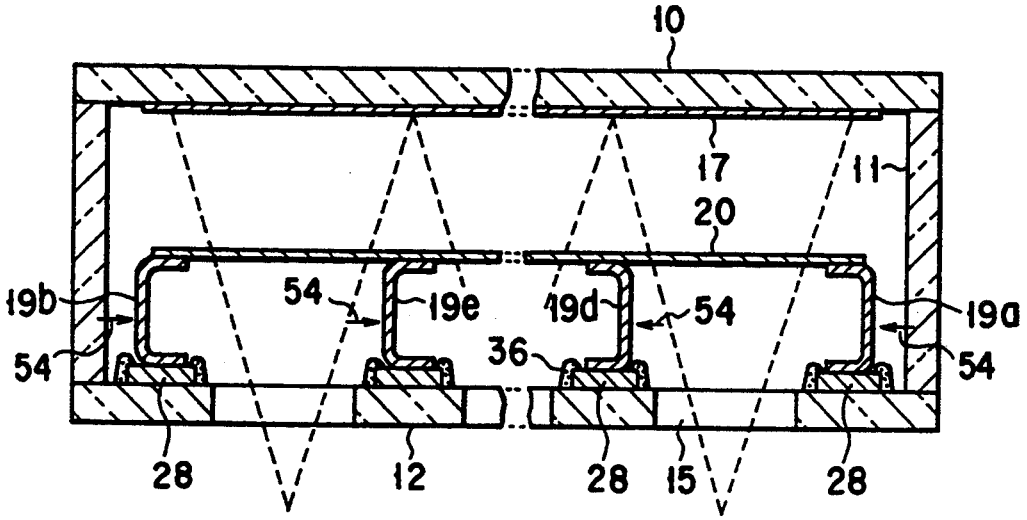
Figure 9:
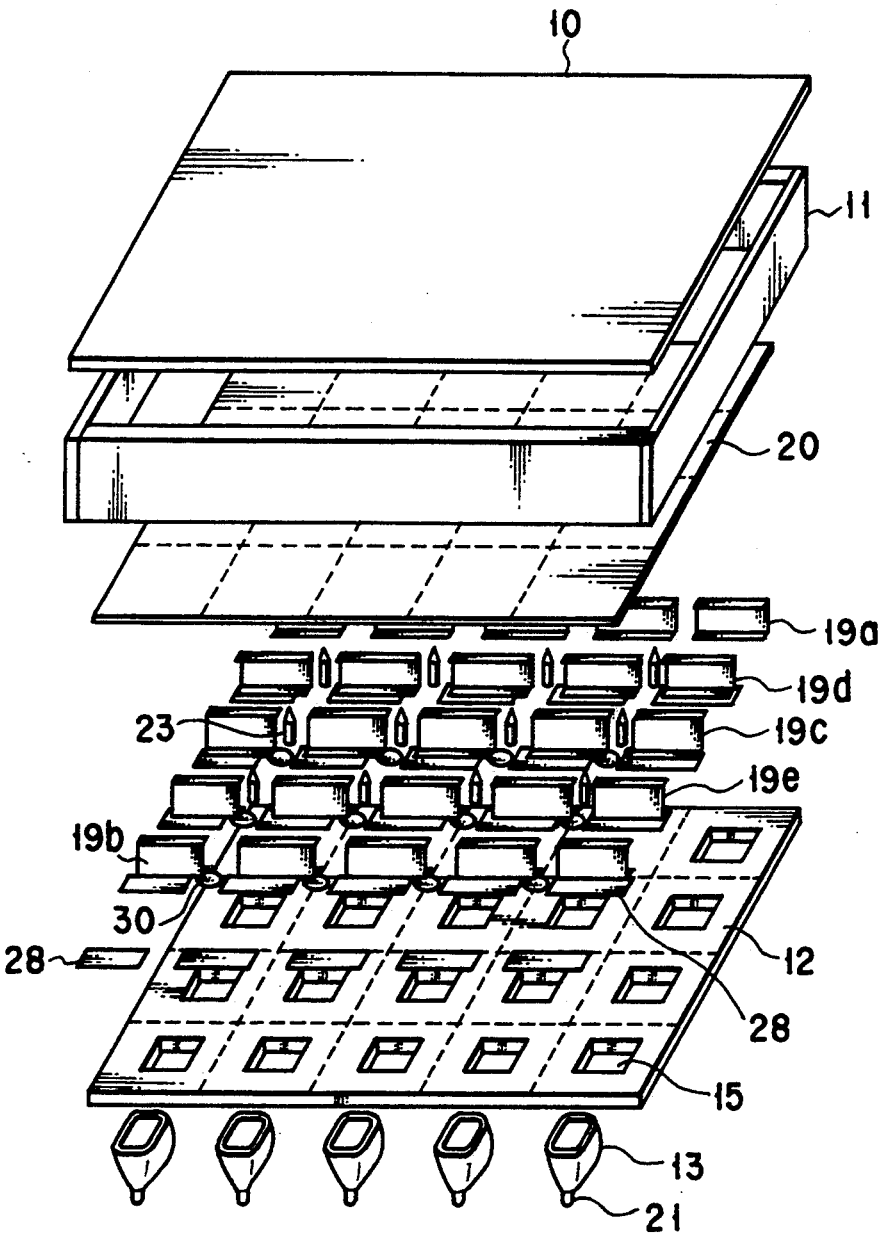
Figure 11:
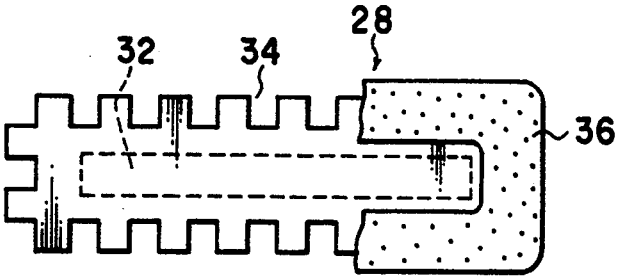

Specifically, as shown in FIGS. 9 to 11, each of the first fixing members 28 is formed of a nickel alloy plate in a rectangular-plate shape, the nickel alloy plate having a thermal expansion property similar to that of the rear plate 12 made of glass. These fixing members 28 are fixed to those portions of the inner surface of the rear plate 12, which correspond to boundary portions of vertically adjacent regions of the divisionally scanned regions R1, R2, R3 . . . R20 of the phosphor screen 17. Specifically, each of the fixing members 28 is disposed between the two vertically adjacent openings 15 of the rear plate 12 and the longitudinal direction of each fixing member 28 coincides with the horizontal direction. The area of each fixing member 28 is greater than that of the bent portion of each mask support member 19. Each fixing member 28 has a central flat portion 32, and a corrugated peripheral portion 34 is formed on the outer periphery of the flat portion 32. In the state in which each fixing member 28 is placed on the rear plate 12, frit glass 36 is coated on that surface (face plate-side upper surface) of the corrugated peripheral portion 34, which is opposite to the face plate 10, and on the side surface of the peripheral portion 34. By sintering the frit glass 36, the fixing members 28 can be closely attached on the inner surface of the rear plate 12, substantially without putting frit glass between the rear plate 12 and the flat portion 32. Then, the bent portion of the mask support member 19 is welded onto the flat portion 32 of the corresponding fixing member 28.

Figure 12:
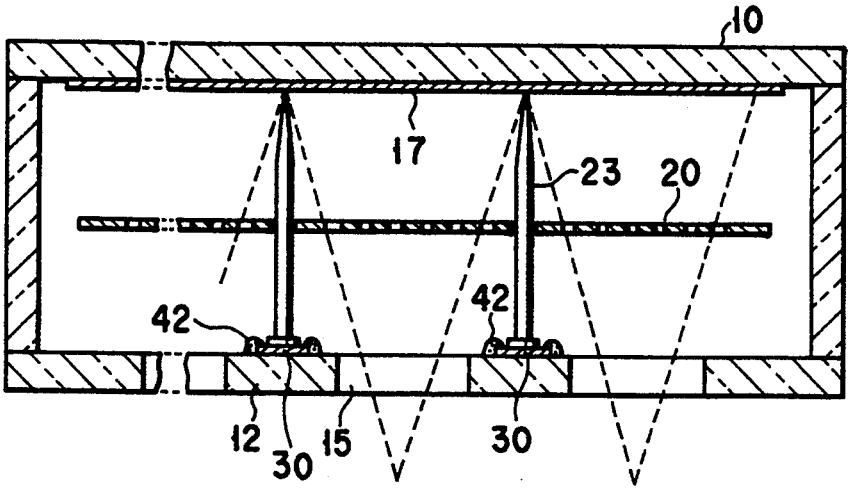
Figure 13:
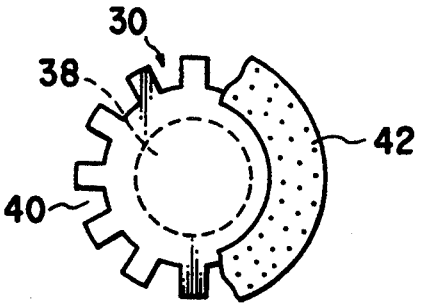

As shown in FIGS. 9, 12 and 13, each of the second fixing members 30, like the first fixing members 28, is formed of a nickel alloy plate in a disc-like shape, the nickel alloy plate having a thermal expansion property similar to that of the rear plate 12 made of glass. These fixing members 30 are fixed on those portions of the inner surface of the rear plate 12, which lie between the two adjacent first fixing members 28. Each fixing member 30 has a central flat portion 38, and a corrugated peripheral portion 40 is formed on the outer periphery of the flat portion 38. In the state in which each fixing member 30 is placed on the rear plate 12, frit glass 42 is coated on that surface of the corrugated peripheral portion 40, which is opposite to the face plate 10, and on the side surface of the peripheral portion 40. By sintering the frit glass 42, the fixing members 30 can be closely attached onto the inner surface of the rear plate 12, substantially without putting frit glass between the rear plate 12 and the flat portion 38. Then, a proximal end of the plate support member 23 is welded to the flat portion 38 of the corresponding fixing member 30.

A desirable method for welding the support members 19 and 23 to the first and second fixing members 38 and 30 is a method capable of avoiding, as much as possible, thermal deformation of related parts during and after welding. Thus, a laser welding method capable of keeping parts, other than welded parts, at normal temperatures is optimal.

Since the other structures are the same as those in the first embodiment, the common parts are denoted by like reference numerals and detailed descriptions thereof will be omitted.

The color cathode-ray tube having the above-mentioned structure is manufactured in the following process. Before manufacturing the envelope by coupling the face plate 10, side wall 11, rear plate 12 and funnel 13 by frit glass, the first and second fixing members 28 and 30 having predetermined sizes and shapes are positioned on the inner surface of the rear plate 12. These fixing members 28 and 30 are fixed to the rear plate 12 by means of frit glass. In this case, it is desirable to secure the fixing members 28 and 30 on the rear plate 12 while pressing these fixing members against the rear plate 12, thereby preventing the frit glasses 36 and 42 from entering a gap between the rear surfaces of the flat portions 32 and 38 of the fixing members 28 and 30 and the rear plate 12. The area of the flat portion 32 of each first fixing member 28 is greater than that of the bent portion of the mask support member 19, and similarly the area of the flat portion 38 of each second fixing member 30 is greater than that of the proximal end portion of each plate support member 23. Thus, the fixing position for the fixing members 28 and 30 does not require very high precision.

Figure 14:
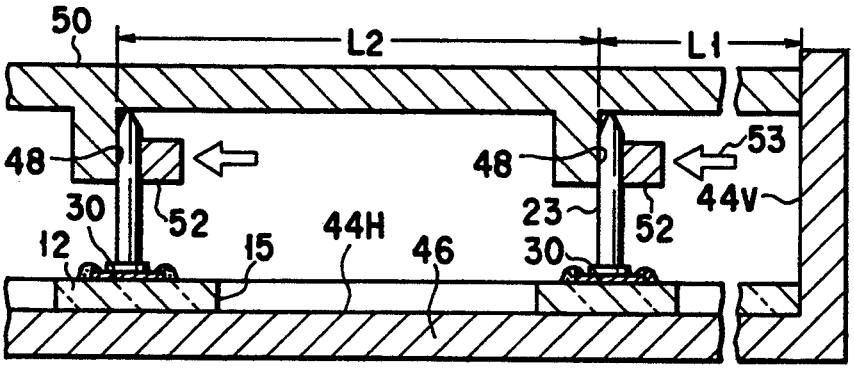
FIG. 14 is a cross-sectional view showing an alignment jig for the plate support members.

Subsequently, as shown in FIG. 14, by using a lower jig 46 and an upper jig 50, the support members 23 are positioned on the second fixing members 30 fixed to the rear plate 12. The lower jig 46 has a horizontal reference face 44H and a vertical reference face 44V located at one end of the horizontal reference face 44H. The upper jig 50 has reference faces 48 for positioning plate support members 23. Specifically, the rear plate 12 on which the first and second fixing members 28 and 30 are attached is placed on the horizontal reference face 44H of the lower jig 46, while the fixing members facing upwards. One end face of the rear plate 12 is abutted against the vertical reference face 44v. Thus, the rear plate 12 is positioned. The plate support members 23 are erected on the second fixing members 30 on the positioned rear plate 12. The upper jig 50 is placed on the support members 23 under a suitable pressure. While one end face of the upper jig 50 abuts against the vertical reference face 44V of the lower jig 46, a force in the direction of arrow 53 is applied to side faces of tip portions of the support members 23 via blocks 52, and the support members 23 are pressed against references faces 48 of the upper jig 50. Thus, the positioning of the support members 23 is effected. A distance L1 between one end face of the upper jig 50 and the rightmost reference face 48 of the upper jig 50 and a distance L2 between two adjacent reference faces 48 are precisely determined, whereby the plate support members 23 can be exactly positioned by the upper and lower jigs 50 and 46. Thereafter, the positioned plate support members 23 are welded to the corresponding second fixing members 30 by means of laser welding.

Following the above, the mask support members 19 are arranged on the first fixing members 28 and, instead of the upper jig 50, another upper jig (not shown) designed for the support members 19 is placed on the support members 19 under a suitable pressure. After the mask support members 19 are positioned by a method similar to the above, the support members 19 are welded to the corresponding first fixing members 28 by means of laser welding. Then, a shadow mask 20 is welded to the mask support members 19 in the same manner as in the first embodiment.

Thereafter, using the rear plate 12 on which the mask support members 19, plate support members 23, and shadow mask 20 are fixed, an envelope 14 is constituted and a cathode-ray tube is completed.

There are several methods of constituting the envelope. According to one example, the face plate 10 having the inner surface provided with the phosphor screen 17, the side wall 11, the rear plate 12 on which the support members 19 and 23 are fixed, and the funnels 13 having necks 21 in which the electron guns 22 are sealed are positioned by jigs (not shown) in a predetermined positional relationship, and a shadow mask is arranged in this resultant structure. Then these components 10, 11 and 12 are coupled with each other by means of frit glass. The assembled envelope is evacuated, thereby constituting the cathode-ray tube. Like the first embodiment, the shadow mask 20 is welded to the mask support members 19 while the mask support members, excluding the central support members 19*c*, are resiliently deformed slightly inwardly so that a tensile force is applied to the shadow mask 20 in a direction of extension of the three-color phosphor layers.

In the above embodiment, the face plate, side wall, rear plate and funnels are coupled by frit glass to constitute the envelope. However, the components of the envelope may not be coupled by frit glass. For example, the face plate and side wall may be formed as one body, or separately formed face plate and side wall may be welded to each other.

According to the second embodiment with the above structure, the following advantages can be obtained, in addition to the advantages of the first embodiment. That is, in the second embodiment, the first and second fixing members 28 and 30 are fixed to the rear plate 12, and the mask support members 19 and plate support members 23 are fixed to these fixing members. The positional precision of the support members 19 and 23 relative to the rear plate 12 is determined by the positional precision of the support members 19 and 23 relative to the fixing members 28 and 20 and not by the positional precision of the fixing members relative to the rear plate 12. Accordingly, when the coated frit glass is sintered to secure the fixing members 28 and 30 onto the rear plate 12, no special high-precision positioning jig is required (even if such a jig is used, a jig with simple structure is sufficient). In the case where the width of the bent portion of the mask support member 19 and the diameter of the proximal end portion of the plate support member 23 is, for example, 10 mm, the width of the first fixing member 28 and the diameter of the second fixing member 30 is about 15 mm and a sufficient allowance is provided for the positioning of the support members 19 and 23. Thus, even when a slight displacement occurs in securing the fixing members 28 and 30 on the rear plate by frit glass, the mask support members and plate support members can be precisely positioned, regardless of the displacement of the fixing members.

In addition, the mask support members 19 and plate support members 23 are fixed to the corresponding fixing members 28 and 30 by laser welding while these support members are positioned. Thus, the support members and fixing members are welded and fixed at substantially normal temperatures, without being heated up to high temperatures. Accordingly, the fixation of the support members 19 and 23 is neither influenced by thermal expansion nor by a variation in temperature distribution which may occur in the case of fixing the support members 19 and 23 by frit glass. As a result, the support members 19 and 23 can be precisely fixed at predetermined positions.

The first and second fixing members 28 and 30 have corrugated peripheral portions 34 and 40 formed around the flat portions 25 and 30 on which the mask support members 19 and plate support members 23 are to be mounted. The frit glass 36 and 42 is coated on these peripheral portions 34 and 40 and is sintered, thereby fixing the peripheral portions 34 and 40 onto the rear plate 12. In this case, the coated frit glass 36, 42 enters recesses of the peripheral portions 34 and 40 and firmly secures the fixing members 28 and 30 onto the rear plate 12. In particular, when the shadow mask 20 is to be fixed to the mask support members 19 on the first fixing members 28, in order to apply a tensile force to the shadow mask 20, the shadow mask 20 is welded to the support members 19 while the support members 19 are slightly inclined by the force acting inwardly from the side wall 11, as indicated by arrows 54 in FIG. 10. Consequently, an external force corresponding to the force in the direction of arrow 54 acts on the first fixing members 28. According to the above structure, however, the fixing strength of the fixing members 28 in the direction of arrow 54 can be remarkably increased, so that peeling or floating of the fixing members 28 from the rear plate 12 can be prevented.

Unlike the case wherein oxide films are formed on the surfaces of the fixing members for securing fixing members to rear plates, according to the second embodiment, the covering of the peripheral portions 34 and 40 of the fixing members 28 and 30 with the frit glass 36, 42 contributes greatly to securing of the fixing members. Thus, the securing of the fixing members 28 and 30 is stable and not influenced by deformation, warp, contamination or defective oxide films of the peripheral portions 26 and 31 of the fixing members 28 and 30.

The first fixing members 28 for mounting the mask support members 19 and the second fixing members 30 for mounting the plate support members 23 have the flat portions 32 and 38, respectively. The flat portions 32 and 38 are closely attached to the rear plate 12 such that no frit glass is substantially put between the flat portions 32 and 38 and the inner surface of the rear plate 12. If the fixing members are secured the inner surface of the rear plate 12 with frit glass interposed therebetween, the thickness of the frit glass varies in a range of 0 to 0.5 mm. In the case of the present embodiment, however, the height of the fixing members 28 and 30 is determined only by the thickness of each fixing member. By determining the thickness of each fixing member precisely, the heights of the fixing members 28 and 30 after being fixed to the rear plate 12 can be exactly maintained within a predetermined range or with little variation, irrespective of the amount of the coated frit glass 36, 42. Accordingly, the heights of the mask support members 19 and plate support members 23 secured on the first and second fixing members 28 and 30 can be maintained with high precision.

The inventors conducted various computer simulations and experiments with use of an actual vacuum envelope. They found that the amount of deformation of the face plate 10 of the vacuum envelope having a predetermined resistance to atmospheric pressure due to the load of atmospheric pressure is nearly zero at portions put in contact with the plate support members 23 and takes a maximum value (about 0.5 mm) at an intermediate portion between two adjacent plate support members. This result is obtained in the case where the heights of all plate support members 23 are equal and the load due to atmospheric pressure is applied uniformly to all support members 23. If there are some support members 23 which do not have a predetermined height, the load due to atmospheric pressure acts on the face plate non-uniformly. Non-uniformity of the load is most conspicuous when a central one of three adjacent plate support members 23 is higher than the others.

In order to examine the influence due to this non-uniform load, the inventors examined the variation of the strength of the envelope 14 against atmospheric pressure, with the height of the plate support members 23 varied. It was found that although the guaranteed strength of the vacuum envelope must normally be three times the atmospheric pressure, when the height of one plate support member 23 was higher the other support members by about 50% of the maximum deformation amount, the strength of the envelope against atmospheric strength is lowered by about 30%. However, when the height of one support member 23 was higher than other support members by only about 20% of the maximum deformation amount, the strength against atmospheric pressure was not varied.

From the above results, in the cathode-ray tube of the present embodiment, the required precision of the height of the plate support members 23 is 0.1 mm which corresponds to 20% of the maximum deformation amount of the face plate. This value is, in fact, not high as processing precision of the support member 23 having a wedge-shaped tip portion, and it makes possible mass production of the support members 23. In addition, this value indicates that a variation of the height of the support member is low, compared to the case where the thickness of the frit glass lying between the inner surface of the rear plate 12 and the fixing members varies in the range of 0 to 0.5 mm when the fixing members are fixed to the inner surface of the rear plate 12 with the frit glass interposed therebetween.

In addition, since the mask support members 19 can be easily manufactured with predetermined processing precision, the heights of all mask support members 19 can be made constant. Accordingly, the positional precision of the shadow mask 20 attached to the mask support members 19 can be made very high, and the distance (q-value) between the inner surface of the face plate 10 and the surface of the shadow mask 20 can be exactly determined. The precision of the q-value depends on the processing precision of the mask support members 19, like the case of the plate support members 23. The precision of the q-value is not actually high as precision of an ordinary single part. As described in connection with the above embodiment, the allowable error $\Delta q$ of the q-value is expressed by $\Delta q = D \cdot (L-q)/(H/2+D)$. The required precision of the q-value in the cathode-ray tube of this embodiment (i.e. the required processing precision of the mask support members 19) is 0.06 mm. This precision can be achieved by a conventional low-cost processing method.

As has been described above, according to the second embodiment, the attachment position and height of the plate support members can be precisely determined, the face plate and rear plate can uniformly withstand the applied load due to atmospheric pressure, and thereby the cathode-ray tube capable of sufficiently withstanding the load due to atmospheric pressure can be obtained. Furthermore, since the attachment position and height of the mask support members can be precisely determined, the distance between the phosphor screen and the shadow mask can be precisely determined. As a result, a cathode-ray tube capable of displaying images with no color-dislocation can be obtained.

The present invention is not limited to the above-mentioned embodiments, and various changes and modifications can be made without departing the spirit of the invention.

For example, in the above embodiments, the first to fourth mask support members 19*a*, 19*b*, 19*d* and 19*e* have a substantially U-cross section. However, these members may have other cross section, e.g. I-cross section. The stiffness of the central support members 19*c* may be enhanced to prevent them from falling down.

In the above embodiments, the shadow mask is welded to all mask support members. However, the shadow mask may be welded to only the first and second support members located on both sides in the direction of extension of the striped phosphor layers, and simply put in contact with the other third, fourth and central support members. In this case, warping of the shadow mask can be prevented by the mask support members, and the shadow mask can be exactly held in a predetermined position in relation to the phosphor screen. In this case, it is desirable that the shadow mask be pressed against the third, fourth and central support members by urging means such as a spring.

In the above embodiments, the first and second fixing members on which the mask support members and plate support members are mounted are formed in a plate shape. However, these fixing members may be formed in a three-dimensional shape with a certain thickness. Only the side faces of these fixing members and the rear plate may be coated with frit glass, and by sintering the frit glass, these fixing members can be fixed to the rear plate.

Further, in the above embodiments, the mask support members have a substantially U-cross section. When these support members are applied to a cathode-ray tube with a greater screen size, color-dislocation may likely occur due to thermal expansion of the shadow mask caused by collision of electron beams. In particular, color dislocation is conspicuous at peripheral edge portions of the screen where thermal expansion is accumulated. Thus, regarding such a cathode-ray tube with a greater screen size, it is desirable to divide the shadow mask into a plurality of components in a horizontal direction perpendicular to the longitudinal direction of the striped phosphor layers. By dividing the shadow mask, accumulation of thermal expansion can be decreased, and color-dislocation prevented.

Figure 15:
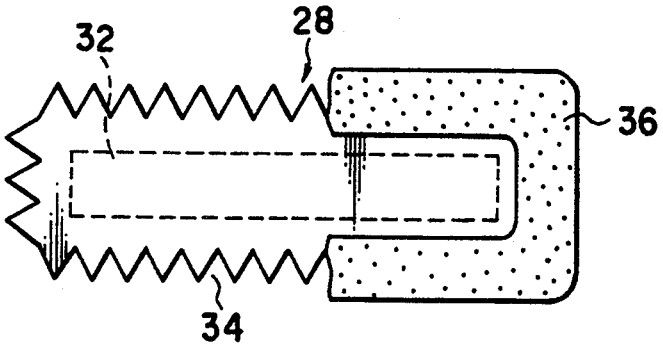
FIG. 15 is a plan view showing a first modification of the first fixing member.
Figure 16:
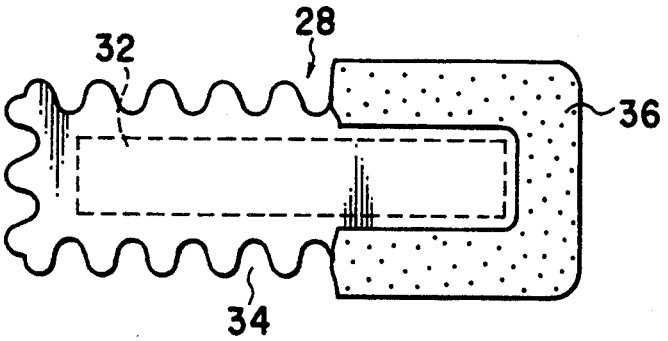
FIG. 16 is a plan view showing a second modification of the first fixing member.
Figure 17:
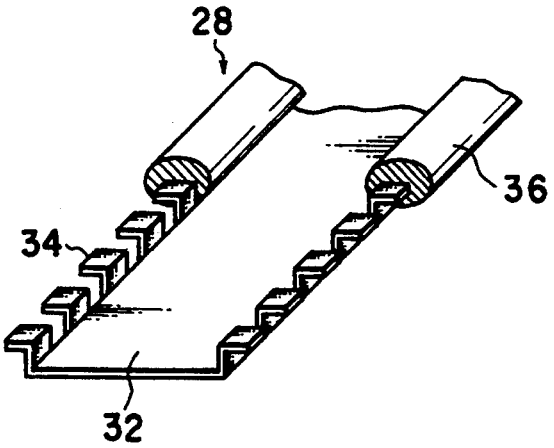
FIG. 17 is a perspective view showing a third modification of the first fixing member.

In the above embodiments, the peripheral portions of the first and second fixing members have tooth-shaped corrugations. However, these peripheral portions may have corrugations of other shapes, for example, saw-tooth-shaped corrugations as shown in FIG. 15, or wavy-shaped corrugations as shown in FIG. 16. In these cases, too, the same advantages as in the second embodiment can be obtained. In addition, as shown in FIG. 17, the peripheral portions of the fixing members may be provided with corrugations not only in the circumferential direction but also in the height direction. Further, the corrugations of the peripheral portions of the fixing members may be formed at only part of the periphery of each fixing member, and not the entire periphery. Besides, the frit glass may be coated on the periphery of each fixing member discontinuously, and not continuously.

As has been stated above, it is important that the flat portions of the fixing members are closely contact with and fixed to the inner surface of the rear plate, in order to reduce a variation in height of the mask support members and plate support members. However, even when frit glass coated on the peripheral portions of the fixing members enters between the flat portions of the fixing members and the rear plate at the time of coating or sintering, if the amount of the frit glass is small, there is no problem of precision and the same advantages as in the above embodiments can be obtained. In the above embodiments, the first fixing members for fixing the mask support members and the second fixing members for fixing the plate support members are provided individually. However, these fixing members may be commonly integrated in groups of horizontal rows.

In the above embodiments, the mask support members and plate support members are secured on the rear plate via the fixing members. When fixing members are used, various members can be fixed by applying frit glass to the fixing members only in one direction. Thus, the above structure is applicable not only to the fixation of the support members, but also to the fixation of other members such as terminal tables for supplying anode high voltage, reference plates for measuring and setting positions of various members, etc.

The above embodiments are directed to the cathode-ray tube functioning as a color picture tube with a shadow mask. However, this invention is applicable to other cathode-ray tubes such as a monochrome picture tube without a shadow mask, a beam index type color picture tube, etc.

The above embodiments are directed to the cathode-ray tube having an electron gun as beam emitting means. However, the beam emitting means may be provided with a linear electron discharge source.

Moreover, in the above embodiments, the electron beam is deflected electromagnetically by means of the deflection yoke. However, the electron beam may be deflected electrostatically by using an electrostatic deflection plate.

What is claimed is:

1. A cathode-ray tube comprising:

an envelope having a substantially rectangular first plate and a substantially rectangular, flat second plate opposed at a distance to the first plate;

a phosphor screen formed on the inner surface of the first plate and having a number of striped phosphor layers extending in parallel to one another, and a plurality of regions, each of the phosphor layers having first and second longitudinal ends;

a shadow mask arranged within the envelope;

mask support means for supporting the shadow mask such that the shadow mask is opposed at a distance to the phosphor screen, said mask support means including a first support portion fixed to the inner surface of the second plate and situated to face the first longitudinal ends of the phosphor layers, a second support portion fixed to the inner surface of the second plate and situated to face the second longitudinal ends of the phosphor layers, and an intermediate support portion fixed to the inner surface of the second plate and situated between the first and second support portions, said shadow mask being supported on the first, second and intermediate support portions while being applied with a tensile force in the longitudinal direction of the phosphor layers; and beam emitting means attached to the second plate, for emitting electron beams for scanning the regions of the phosphor screen independently of one another.

2. A cathode-ray tube according to claim 1, wherein said first support portion has first mask support members fixed to the inner surface of the second plate and arranged in a direction substantially perpendicular to the phosphor layers, said second support portion has second mask support members fixed to the inner surface of the second plate and arranged in a direction substantially perpendicular to the phosphor layers, and said intermediate support portion has central mask support members fixed to the inner surface of the second plate between the first and second mask support members and arranged in a direction substantially perpendicular to the phosphor layers.

3. A cathode-ray tube according to claim 2, wherein said second plate has a plurality of openings arranged in a matrix, said beam emitting means comprises a plurality of funnels fixed to the outer surface of the second plate so as to cover the respective openings, and electron guns arranged within the respective funnels, and each of said central mask support members is fixed to the second plate between adjacent two of said openings.

4. A cathode-ray tube according to claim 3, wherein said shadow mask has a plurality of effective portions each having a number of through-holes which are arranged in a matrix for passing electron beams through, a peripheral portions with no through-holes, and boundary portions located between the effective portions and having no through-holes, said first and second mask support members supporting the peripheral portions of the shadow mask, said central mask support members supporting the boundary portions of the shadow mask.

5. A cathode-ray tube according to claim 2, wherein said second plate is formed of glass, and said first, second and central mask support members are formed of a metal having a thermal expansion property substantially equal to that of the glass and are fixed to the second plate by means of a bonding agent.

6. A cathode-ray tube according to claim 2, wherein said second plate is formed of glass, said support means comprises a plurality of fixing members which are formed of a metal having a thermal expansion property substantially equal to that of the glass and are secured to the second plate, and said first, second and central mask support members are fixed onto the fixing members, respectively.

7. A cathode-ray tube according to claim 6, wherein each of said fixing members has a lower face put in close contact with the second plate and an upper surface opposed to the shadow mask, and is fixed to the second plate by a bonding agent coated to cover a peripheral portion of the upper face of the fixing member.

8. A cathode-ray tube according to claim 7, wherein each of said fixing members has a corrugated portion formed on the peripheral portion of the fixing member.

9. A cathode-ray tube according to claim 8, wherein said first, second and central mask support members are formed of an elastic metal and are welded to the upper surfaces of the fixing members.

10. A cathode-ray tube according to claim 9, wherein each of said first and second mask support members has a vertical portion extending substantially perpendicular to the second plate, a lower end portion extending in parallel to the second plate and in a direction substantially perpendicular to the phosphor layers and being fixed to the upper surface of the corresponding fixing member, and an upper end portion extending in parallel to the second plate and in a direction substantially perpendicular to the phosphor layers and being fixed to the shadow mask, said upper and lower end portions extending from the vertical portion towards the central mask support members.

11. A cathode-ray tube according to claim 6, which further comprises plate support means for bearing a load of atmospheric pressure acting on the first and second plates, wherein said plate support means comprises a plurality of second fixing members each formed of a metal having a thermal expansion property substantially equal to that of glass and fixed to the inner surface of the second plate by a bonding agent, and a plurality of plate support members each having a proximal end fixed to the corresponding second fixing member and a distal end put in contact with the phosphor screen.

12. A cathode-ray tube according to claim 11, wherein each of said second fixing members has a lower face put in close contact with the second plate and an upper surface opposed to the shadow mask, and is fixed to the second plate by a bonding agent coated to cover a peripheral portion of the upper surface.

13. A cathode-ray tube according to claim 12, wherein each of said second fixing members has a corrugated portion formed on the peripheral portion of the second fixing member, and the bonding agent is coated to cover the corrugated portion.

14. A cathode-ray tube according to claim 13, wherein said plate support members are formed of a metal and are welded to the upper surfaces of the corresponding second fixing members.

15. A cathode-ray tube according to claim 11, wherein said phosphor screen has black stripes formed between adjacent ones of the phosphor layers, and each of the plate support members has an elongated contact face which is formed at the distal end thereof, put in contact with the corresponding black stripe, and extends in the longitudinal direction of the black stripe.

16. A cathode-ray tube comprising:

an envelope having a substantially rectangular first plate and a substantially rectangular, flat second plate made of glass which is opposed at a distance to the first plate;

a phosphor screen formed on the inner surface of the first plate and having a number of striped phosphor layers extending in parallel to one another, and a plurality of regions, each of the phosphor layers having first and second ends;

a shadow mask arranged within the envelope;

mask support means for supporting the shadow mask such that the shadow mask is opposed at a distance to the phosphor screen, said mask support means including a plurality of fixing members made of a metal having a thermal expansion property substantially equal to that of glass and fixed to the inner surface of the second plate by a bonding agent, first mask support members fixed to the fixing members and situated to face the first longitudinal ends of the phosphor layers, and second mask support members fixed to the fixing members and situated to face the second longitudinal ends of the phosphor layers, said shadow mask being supported on the first and second support members while being applied with a tensile force the longitudinal direction of the phosphor layers; and beam emitting means attached to the second plate, for emitting electron beams for scanning the regions of the phosphor screen independently of one another.

17. A cathode-ray tube according to claim 16, wherein each of said fixing members has a lower face put in close contact with the second plate and an upper surface opposed to the shadow mask, and is fixed to the second plate by a bonding agent coated to cover a peripheral portion of the upper surface.

18. A cathode-ray tube according to claim 17, wherein each of said fixing members has a corrugated portion formed on the peripheral portion of the upper surface thereof, and the bonding agent is coated to cover the corrugated portion.

19. A cathode-ray tube according to claim 17, wherein said first and second mask support members are formed of an elastic metal and are welded to the upper surfaces of the corresponding fixing members.

* * * * *